US007048621B2

(12) United States Patent
Chen et al.

(10) Patent No.: US 7,048,621 B2
(45) Date of Patent: May 23, 2006

(54) RETAINING RING DEFLECTION CONTROL

(75) Inventors: Hung Chih Chen, Santa Clara, CA (US); Steven M. Zuniga, Soquel, CA (US)

(73) Assignee: Applied Materials Inc., Santa Clara, CA (US)

( * ) Notice: Subject to any disclaimer, the term of this patent is extended or adjusted under 35 U.S.C. 154(b) by 0 days.

(21) Appl. No.: 10/975,564

(22) Filed: Oct. 27, 2004

(65) Prior Publication Data

US 2006/0089092 A1 Apr. 27, 2006

(51) Int. Cl.
*B24B 41/06* (2006.01)

(52) U.S. Cl. ..... 451/402; 451/398

(58) Field of Classification Search ..... 451/402, 451/397, 398, 285–289, 41, 53
See application file for complete search history.

(56) References Cited

U.S. PATENT DOCUMENTS 5,205,082 A 4/1993 Shendon et al.
5,584,751 A 12/1996 Kobayashi et al.
5,643,053 A 7/1997 Shendon
5,643,061 A 7/1997 Jackson et al.
5,645,474 A 7/1997 Kubo et al.
5,695,392 A 12/1997 Kim
5,759,918 A 6/1998 Hoshizaki et al.
5,993,302 A 11/1999 Chen et al.
6,068,548 A 5/2000 Vote et al.
6,077,151 A * 6/2000 Black et al. ..... 451/53
6,110,025 A * 8/2000 Williams et al. ..... 451/286
6,183,354 B1 2/2001 Zuniga et al.
6,196,905 B1 * 3/2001 Inaba ..... 451/288
6,251,215 B1 6/2001 Zuniga et al.
6,354,928 B1 * 3/2002 Crevasse et al. ..... 451/397
6,422,927 B1 7/2002 Zuniga
6,558,232 B1 * 5/2003 Kajiwara et al. ..... 451/41
6,565,424 B1 * 5/2003 Katagiri et al. ..... 451/285
6,579,151 B1 * 6/2003 Tseng et al. ..... 451/11
6,602,116 B1 8/2003 Prince
6,716,094 B1 4/2004 Shendon et al.

OTHER PUBLICATIONS

Markworth et al., Active Piezo-Controlled Carrier for CMP Systems, IGAM, www.igam-mbh.de.

* cited by examiner

*Primary Examiner*—Dung Van Nguyen
(74) *Attorney, Agent, or Firm*—Fish & Richardson

(57) ABSTRACT

A carrier bead for chemical mechanical polishing of a substrate. The carrier head includes a carrier base, a retaining ring, and a junction connecting the carrier base to the retaining ring. The junction is configured such that vertical movement of the retaining ring is substantially restrained relative to the carrier base. The junction is further configured such that the profile of a bottom surface of the retaining ring is substantially decoupled from flexing and/or expansion of carrier base.

29 Claims, 10 Drawing Sheets

RETAINING RING DEFLECTION CONTROL

BACKGROUND

The present invention relates to a chemical mechanical polishing carrier head that includes a retaining ring, and associated methods.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the exposed surface of the substrate becomes increasingly nonplanar. This nonplanar surface presents problems in the photolithographic steps of the integrated circuit fabrication process. Therefore, there is a need to periodically planarize the substrate surface.

One accepted method of planarization is chemical mechanical polishing (CMP). This planarization method typically requires that the substrate be mounted on a carrier or polishing head. The exposed surface of the substrate is placed against a moving polishing surface, such as a rotating polishing pad. The polishing pad may be a "standard" polishing pad with a durable roughened surface or a "fixed-abrasive" polishing pad with abrasive particles held in a containment media. The carrier head provides a controllable load to the substrate to push it against the polishing pad. A polishing slurry, which may include abrasive particles, is supplied to the surface of the polishing pad.

The effectiveness of a CMP process may be measured by its polishing rate and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the polishing pad.

A reoccurring problem in CMP is the so-called "edge-effect", i.e., the tendency for the edge of the substrate to be polished at a different rate than the center of the substrate. The edge effect typically results in over-polishing (the removal of too much material from the substrate) of the perimeter portion, e.g., the outermost five to ten millimeters, of the substrate. The over-polishing of the substrate perimeter reduces the overall flatness of the substrate, makes the edge of the substrate unsuitable for use in integrated circuits, and decreases the yield.

SUMMARY

In one aspect, the invention is directed to a carrier head for chemical mechanical polishing of a substrate. The carrier head includes a carrier base, a retaining ring, and a junction connecting the carrier base to the retaining ring. The junction is configured such that vertical movement of the retaining ring is substantially restrained relative to the carrier base. The junction is further configured such that the profile of a bottom surface of the retaining ring is substantially decoupled from flexing of carrier base.

Implementations of the invention can include one or more of the following features. The junction can be further configured such that a radial segment extending along the bottom surface of the retaining ring remains substantially flat during polishing.

The junction can include one or more substantially long and narrow support arms. The junction can include one continuous support arm. The support arms can extend from an upper outer surface of the base to the top surface of the retaining ring. Each support arm can have one or more flexible portions. The support arms can be connected to a top surface of retaining ring along a substantially circular path. The substantially circular path can divide the upper surface of the retaining ring into two regions of equal area.

The junction can include one or more support feet. The support feet can be attached to the bottom surface of the carrier base. The support feet can rest on the top surface of the retaining ring. The support feet can be laterally movable relative to the retaining ring. The lateral movement of the support feet on the top surface of the retaining ring can be sufficiently restrained such that the support feet remain on the top surface of the retaining ring. The vertical movement of the retaining ring can be substantially restrained relative to the carrier base by one or more substantially rigid and vertical fasteners that connect the carrier base to the retaining ring.

In another aspect, the invention is directed to a carrier head for chemical mechanical polishing of a substrate. The carrier head includes a carrier base, a retaining ring, and a junction connecting the carrier base to the retaining ring. The junction is configured such that the vertical movement of the retaining ring is substantially restrained relative to the carrier base. The junction is further configured such that the profile of a bottom surface of the retaining ring is substantially decoupled from expansion of the base.

Implementations of the invention can include one or more of the following features. The junction can be further configured such that a radial segment extending along the bottom surface of the retaining ring remains flat during polishing.

The junction can include one or more substantially long and narrow support arms. The junction can include one continuous support arm. The support arms can extend from an upper outer surface of the base to a top surface of the retaining ring. Each support arm can have one or more flexible portions. Support arms can be connected to the top surface of retaining ring along a substantially circular path. The substantially circular path can divide the upper surface of the retaining ring into two regions of equal area.

The junction can include one or more support feet. The support feet can be attached to the bottom surface of the carrier base. The support feet can rest on the top surface of the retaining ring. The support feet can be laterally movable relative to the retaining ring. The lateral movement of the support feet on the top surface of the retaining ring can be sufficiently restrained such that the support feet remain on the top surface of the retaining ring. The vertical movement of the retaining ring can be substantially restrained relative to the base by one or more substantially rigid and vertical fasteners that connect the carrier base to the retaining ring.

In another aspect, the invention is directed to a carrier head for chemical mechanical polishing of a substrate. The carrier head includes a carrier base, a retaining ring, and a junction connecting the carrier base to the retaining ring. The junction is configured such that the carrier base controls the deformation of a bottom surface of the retaining ring.

Implementations of the invention can include one or more of the following features.

The junction can be configured such that an inner portion of the bottom surface of the retaining ring is raised relative to an outer portion of the bottom surface of the retaining ring. The junction can be configured such that an outer portion of the bottom surface of the retaining ring is raised relative to an inner portion of the bottom surface of the retaining ring. The carrier base can control the deformation of the bottom surface of the retaining ring by controlling a lateral distribution of a pressure applied to a top surface of the retaining ring.

The junction can include one or more substantially long and narrow support arms. The support arms can extend from an upper outer surface of the base to the top surface of the retaining ring. The carrier base can control the lateral distribution of the pressure applied to the top surface of the retaining ring by controlling the lateral position of the point of attachment between the one or more support arms and the top surface of the retaining ring.

The junction can include one or more support feet. The support feet can be attached to the bottom surface of the carrier base. The support feet can rest on the top surface of the retaining ring. The support feet can be laterally movable relative to the retaining ring. The carrier base can control the lateral distribution of the pressure applied to the top surface of the retaining ring by controlling the lateral position of a contact location between the support feet and the top surface of the retaining ring.

The junction can include one or more arrays of one or more actuators. At least one of the actuators in the arrays of actuators can be a mechanical actuator. At least one of the actuators in the arrays of actuators can be a piezo-electric actuator.

The invention can be implemented to realize one or more, or none, of the following advantages. Flexing of the retaining ring due to flexing and/or expansion of the carrier base can be reduced. As a result, the "edge effect" can be reduced and wafer-to-wafer polishing uniformity can be improved. Furthermore, the degree of the "edge effect" can be controlled.

The details of one or more implementations of the invention are set forth in the accompanying drawings and the description below. Other features and advantages of the invention will become apparent from the description, the drawings, and the claims.

DETAILED DESCRIPTION

Figure 1:
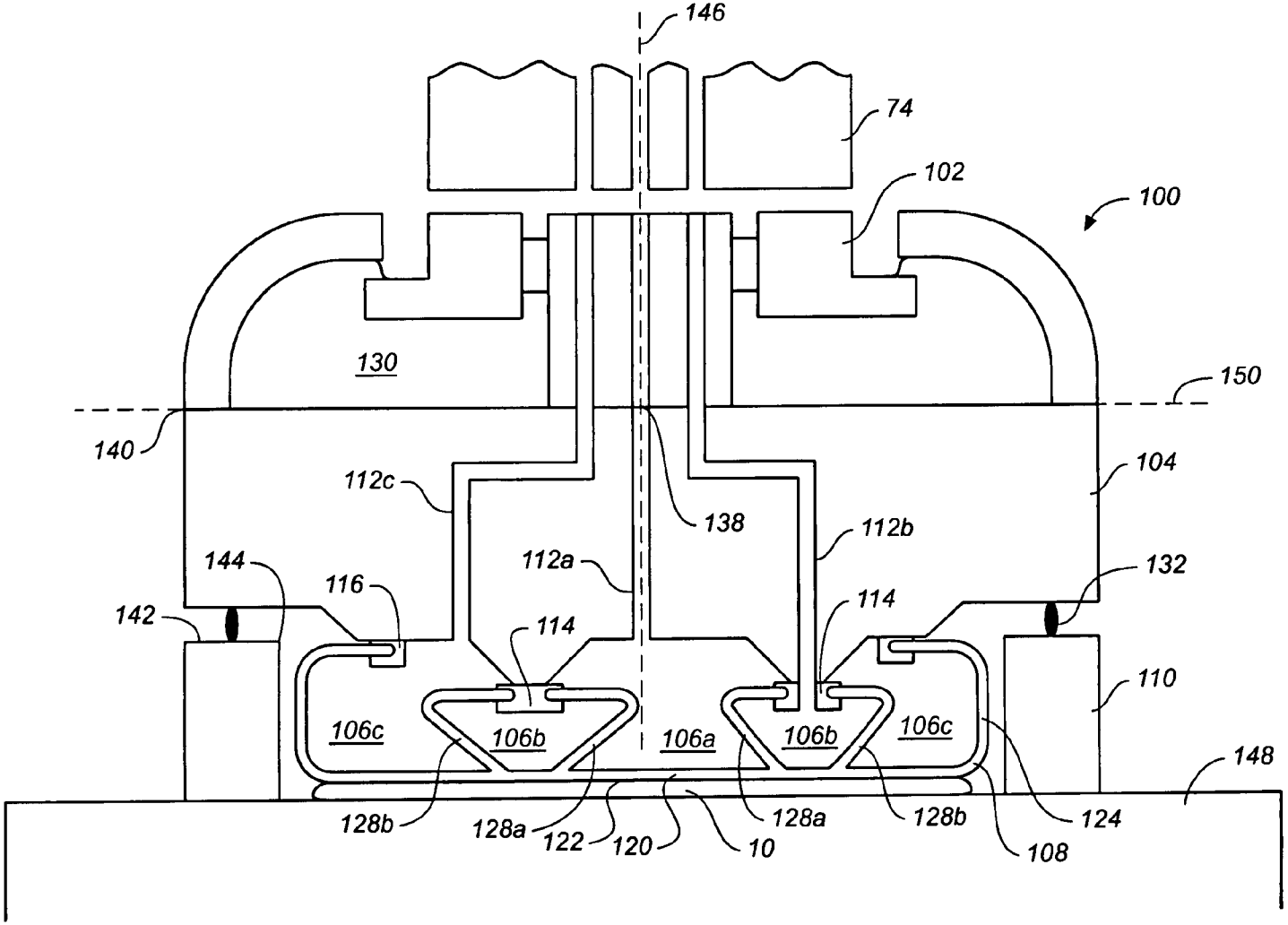
FIG. 1 is a schematic cross-sectional view of a carrier head.

Referring to FIG. 1, one or more substrates 10 will be polished by a chemical mechanical polishing (CMP) apparatus that includes a carrier head 100. A description of a suitable CMP apparatus can be found in U.S. Pat. No. 5,738,574, the entire disclosure of which is incorporated herein by reference.

The carrier head 100 includes a base assembly 104 that is connected to a rotable drive shaft 74, a housing 102 that is securable to the drive shaft 74 and from which the base 104 is movably suspended, an annular loading chamber 130 between the base 104 and the housing 102, a retaining ring 110 that is connected to the base 104 through a junction 132, and a flexible membrane 108. The flexible membrane 108 extends below and is connected to the base 104 to provide multiple pressurizable chambers, including a circular inner chamber 106*a*, a concentric annular middle chamber 106*b*, and a concentric annular outer chamber 106*c*. Passages 112*a*, 112*b* and 112*c* are formed through the base assembly 104 to fluidly couple the chambers 106*a*, 106*b*, 106*c*, respectively, to pressure regulators in the polishing apparatus. Although FIG. 1 illustrates three chambers, the carrier head could have a single chamber, two chambers, or four or more chambers.

The membrane 108 should be hydrophobic, durable, and chemically inert vis-à-vis the polishing process. The membrane 108 can include a central portion 120 with an outer surface that provides a mounting surface 122 for a substrate, an annular perimeter portion 124 that extends away from the polishing surface for connection to the base 104, and one or more concentric annular inner flaps 128*a*, 128*b* that extend from the inner surface of the central portion 120 and are connected to the base 104 to divide the volume between the membrane 108 and the base 104 into the independently pressurizable chambers 106*a*–106*c*. The ends of the flaps 128*a*, 128*b* may be secured to the base 104 by an annular clamp ring 114 (which may be considered part of the base 104). The end of the perimeter portion 124 may also be secured to the base 104 by annular clamp ring 116 (which also may be considered part of the base 104), or the end of the perimeter portion may be clamped between the retaining ring and the base. Although FIG. 1 illustrates two flaps 128*a*, 128*b*, the carrier head could have no flaps, just one flap, or three or more flaps.

Although unillustrated, the carrier head can include other elements, such as a gimbal mechanism (which may be considered part of the base assembly) that permits the base 104 to pivot, one or more support structures inside the chambers 106*a*–106*c*, or one or more internal membranes that contact the inner surface of the membrane 108 to apply supplemental pressure to the substrate. For example, the carrier head 100 can be constructed as described in U.S. Pat. No. 6,183,354, or in U.S. Pat. No. 6,422,927, or in U.S. patent application Ser. No. 09/712,389, filed Nov. 13, 2000, the entire disclosures of which are incorporated by reference.

As mentioned above, a retaining ring 110 is connected to a base 104 through a junction 132. The junction 132 is configured, as described in more detail below, such that the movement of the retaining ring 110 is partially restrained, i.e., the movement of the retaining ring 110 in part depends on the movement of the base 104. At the same time, the movement of the retaining ring 110 is partially decoupled from the base 104, i.e., the movement of the retaining ring 110 is partially independent from the movement of the base 104. In particular, the junction 132 is configured such that the profile of the bottom surface of the retaining ring 110 is independent of the movement of the base 104, thus permitting the bottom surface to remain flat during polishing in order to ensure wafer polishing uniformity.

The junction 132 is configured to partially restrain the lateral movement of the retaining ring 110 relative to the base 104. In particular, the lateral movement of the retaining ring 110 is sufficiently restrained such that that the base 104 remains substantially above the retaining ring 110, and such that the base 104 is capable of applying a downward pressure onto the retaining ring 110 through the junction 132. At the same time, the retaining ring 110 is sufficiently decoupled from the base 104 that the retaining ring 110 can expand laterally due to thermal expansion, e.g., as a result of an increase in temperature during polishing.

The junction 132 can be configured such that the gimbal movement of the retaining ring 110, i.e., rotation of the retaining ring 110 about an axis 150 parallel to the surface of the polishing pad 148 is restrained, i.e., the retaining ring 110 gimbals with the base 104. Alternatively, junction 132 can be configured such that the gimbal movement of the retaining ring 110 is decoupled from the base 104, i.e., the retaining ring 110 does not gimbal with the base 104.

The junction 132 can be configured such that the rotation of the retaining ring 110 about the vertical axis 146 is restrained, i.e., the retaining ring 110 rotates with the base 104. Alternatively, the junction 132 can be configured such that the rotation movement of the retaining ring 110 about the vertical axis 146 is decoupled from the base 104, i.e., the retaining ring 110 does not rotate with the base 104.

The junction 132 is configured such that the vertical movement of the retaining ring 110 is substantially restrained, i.e., the retaining ring 110 moves up or down with the base 104. In particular, if an edge 140 of the base 104 moves upward by some amount, the retaining ring 110 moves upward by the same amount. Likewise, if the edge 140 of the base 104 moves downward by some amount, the retaining ring 110 moves downward by the same amount.

The junction 132 is configured such that the flex movement of the retaining ring 110 is decoupled from the flex movement of the base 104. Flex movement of the retaining ring 110 includes a radially symmetric bending of the retaining ring 110 in which an inner edge 144 of the retaining ring 110 moves either up or down relative to an outer edge 142 of the retaining ring 110. Similarly, flex movement of the base 104 includes a radially symmetric bending of the base 104 in which a center 138 of the base 104 moves either up or down relative to an edge 140 of the base 104. In particular, the junction 132 is configured such that the flex movement of the retaining ring 110 is sufficiently decoupled from the flex movement of the base 104 that the bottom surface of the retaining ring 110 can remain flat in presence of flex movement of the base 104.

Figure 2:
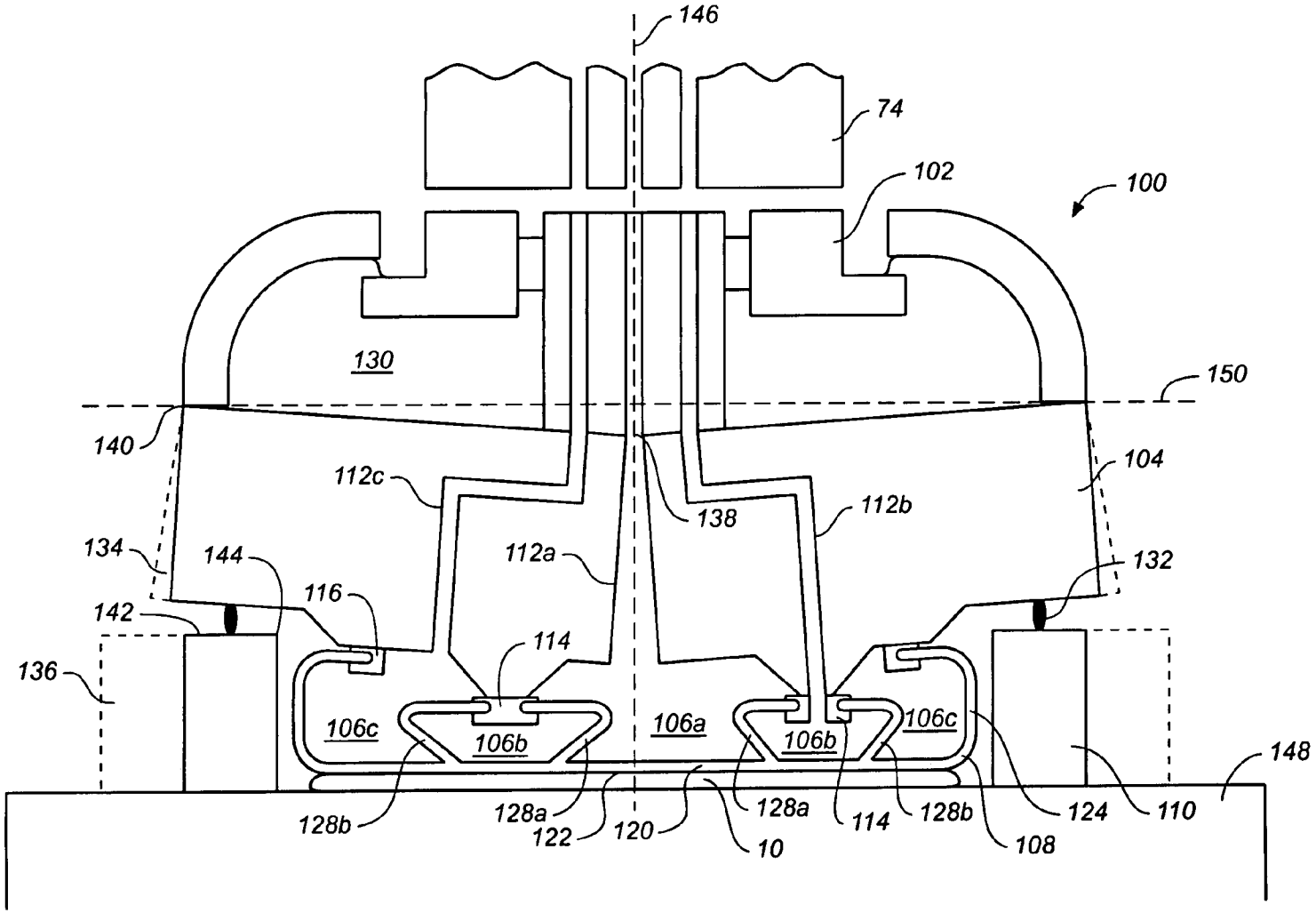
FIG. 2 is a view of the carrier head in FIG. 1 undergoing flexing during polishing.

During polishing fluid is pumped into load chamber 130 and the base 104 is pushed downwardly. Consequently, a downward pressure is applied from the load chamber 130 through the base 104 through the junction 132 onto the retaining ring 110. As a result of the downward pressure applied to the base 104, the base 104 can flex (e.g., a center 138 of the base 104 can move down relative to an edge 140 of the base 104), as illustrated in FIG. 2. As a result of decoupling the flex movement of the base 104 from flex movement of the retaining ring 110, the flex movement of the base 104 does not cause the retaining ring 110 to flex, and the bottom surface of the retaining ring 110 can remain substantially flat during polishing in order to ensure wafer polishing uniformity. In contrast, for a carrier head in which the top surface of the retaining ring is fixed to and abuts the base, e.g., by bolts or adhesive, flex motion of the base tends to result in flex movement of the retaining ring.

The junction 132 is configured such that the expansion or contraction of the retaining ring 110 is decoupled from the expansion or contraction of the base 104, as illustrated in FIG. 2. In particular, the junction 132 is configured such that the expansion movement of the retaining ring 110 relative to the expansion movement of the base 104 is sufficiently unrestrained in order for the bottom surface of the retaining ring 110 to remain flat in presence of thermal expansion in order to ensure wafer polishing uniformity. In contrast, for a carrier head in which the top surface of the retaining ring is fixed to and abuts the base, e.g., by bolts or adhesive, differential expansion of the retaining ring relative to the base would tend to result in bending or flex movement of the retaining ring.

Thermal expansion or contraction results from a change in temperature during polishing. Since the base 104 and the retaining ring 110 may be made of different material, an amount of thermal expansion 134 experienced by the base 104 may be different from an amount of thermal expansion 136 experienced by the retaining ring 110. As a result of decoupling the expansion movement of the base 104 from the expansion movement of the retaining ring 110, the bottom surface of the retaining ring 110 can remain substantially flat during polishing in order to ensure wafer polishing uniformity.

Figure 3:
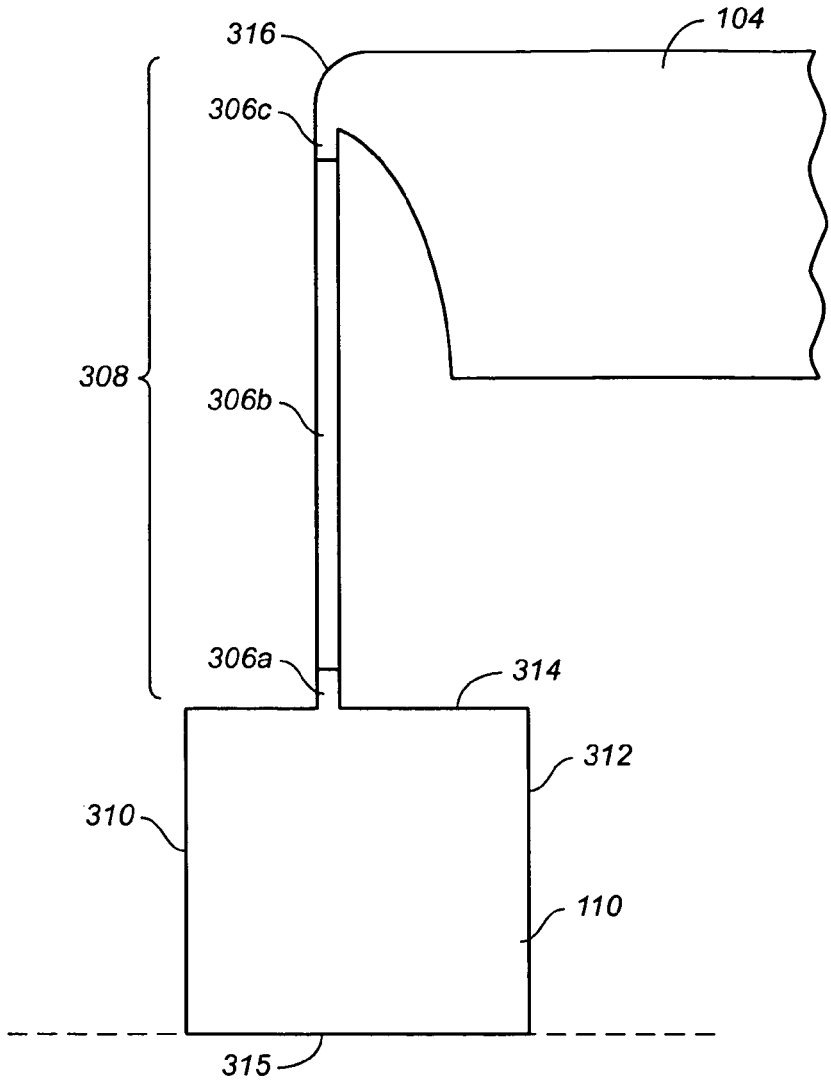
FIG. 3 is an expanded view of a portion of a carrier head according to one implementation.

FIG. 3 shows an implementation of a junction 132 connecting a base 104 to a retaining ring 110. The base 104 is connected to the retaining ring 110 by at least one substantially long and narrow support arm 308 that extends from an upper outer surface 316 of the base 104 to a top surface 314 of the retaining ring 110, which results in an attachment that is vertically constrained. At least a portion of the support arm 308 is flexible. For example, the support arm 308 may be considered to include multiple vertical portions 306*a*, 306*b*, 306*c*, at least one which is flexible. Specifically, the portion is sufficiently flexible that the support arm 308 can flex when a downward pressure is applied to the base 104 during polishing such that the retaining ring 110 does not flex. On the other hand, the portion 306 is sufficiently rigid that the support arm 308 can remain substantially static with respect to the top surface 314 of the retaining ring 110 when no pressure is applied to the base 104.

Figure 4A:
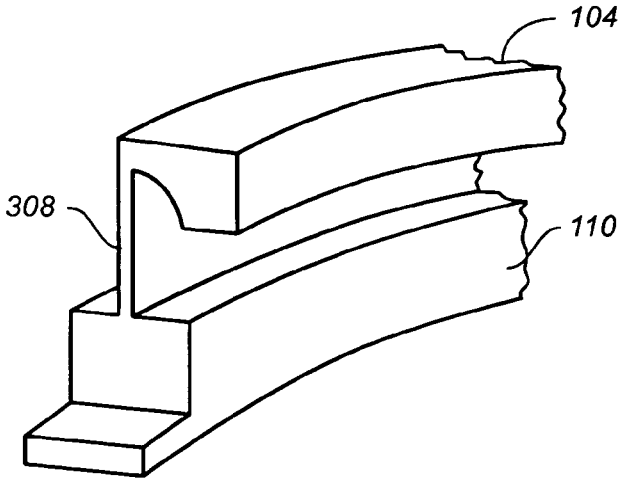
FIG. 4A is perspective view of a retaining ring according to one implementation.

In one implementation, as shown in FIG. 4A, the base 104 is connected to the retaining ring 110 by one continuous support arm 308.

Figure 4B:
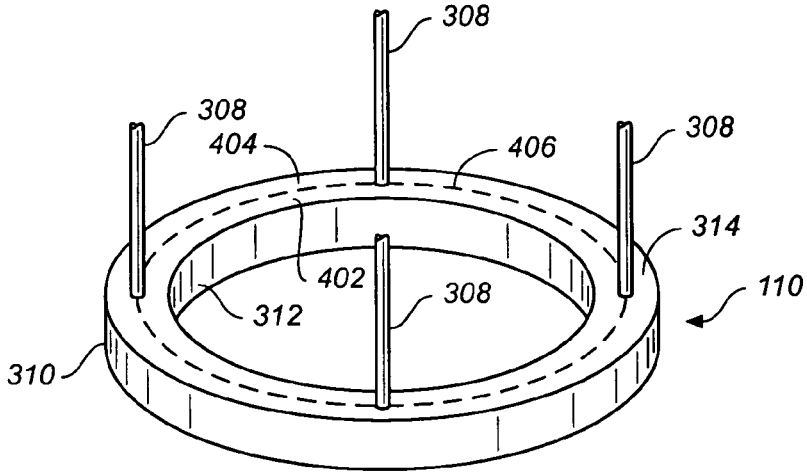
FIG. 4B is perspective view of a retaining ring according to another implementation.

In another implementation, as shown in FIG. 4B, the base 104 is connected to the retaining ring 110 by multiple support arms. The support arms 308 are connected to a top surface 314 of the retaining ring 110 at substantially equal angular intervals along a substantially circular path 406. An area 402 of the top surface 314 of the retaining ring 110 between the substantially circular path 406 and an outer diameter 310 of the retaining ring 110 can be equal to an area 404 of the top surface 314 of the retaining ring 110 between the substantially circular path 406 and an inner diameter 312 of the retaining ring 110. This helps ensure that the distribution of the downward pressure applied from the base 104 to the retaining ring 110 does not result in flex motion of the retaining ring 110.

Figure 5A:
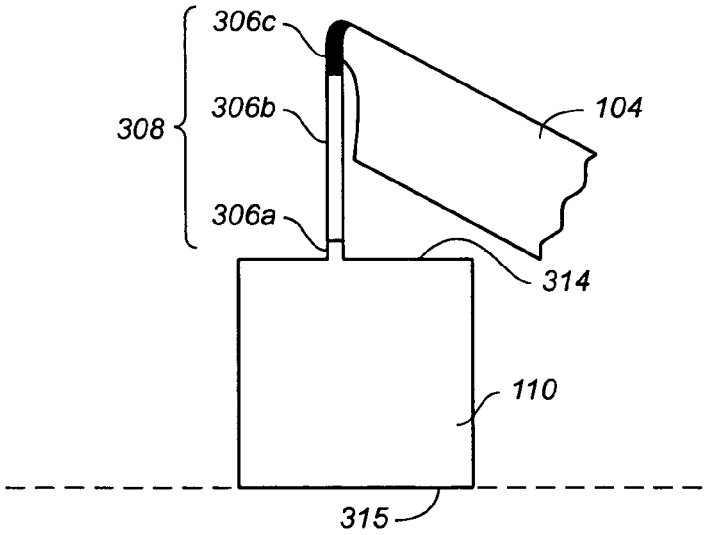
FIGS. 5A–5C are cross-sectional views of the portion of the carrier head according to different implementations.
Figure 5B:
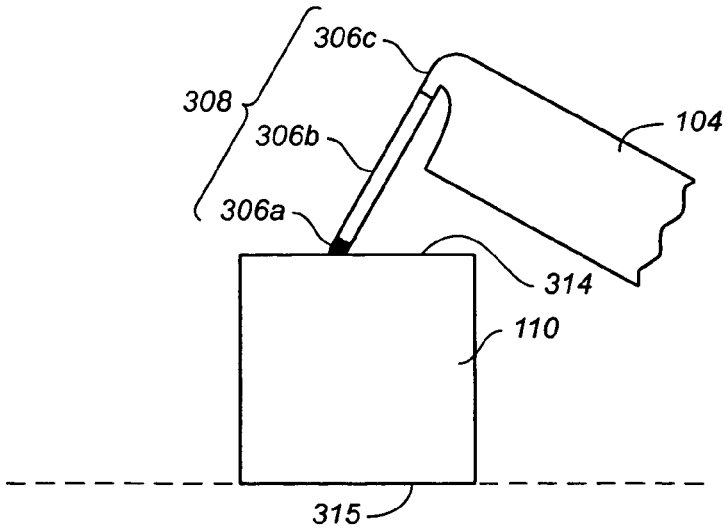
Figure 5C:
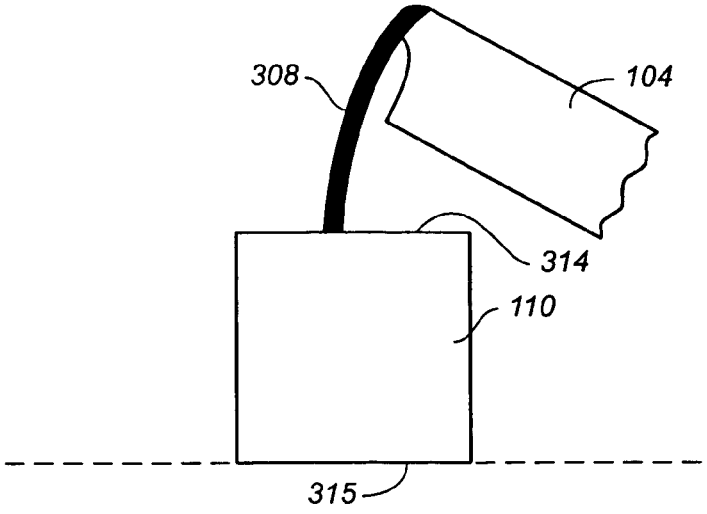

FIGS. 5A–5C show examples of a junction 132 connecting a base 104 to the retaining ring 110.

In FIG. 5A, a support arm 308 extending from an upper outer surface 316 of the base 104 to a top surface 314 of the retaining ring 110 is divided into three portions 306—a lower portion 306*a*, a middle portion 306*b*, and an upper portion 306*c*. A lower portion 306*a* and a middle portion 306*b* are rigid and an upper portion 306*c* is flexible.

FIG. 5B shows another implementation of a support arm 308 extending from an upper outer surface 316 of a base 104 to a top surface 314 of the retaining ring 110. Each support arm 308 is divided into three portions—a lower portion 306*a*, a middle portion 306*b*, and an upper portion 306*c*. The middle portion 306*b* and the upper portion 306*c* are rigid, whereas the lower portion 306*b* is flexible.

FIG. 5C shows another implementation of a support arm 308 extending from an upper outer surface 316 of a base 104 to a top surface 314 of the retaining ring 110. The entire support arm 308 is flexible.

As shown in FIGS. 5A–5C, when the base 104 flexes as a result of a downward pressure applied to it during polishing, a flex movement of the base 104 does not result in a flex movement of the retaining ring 110, and a bottom surface 315 of the retaining ring 110 remains flat during polishing.

Figure 6:
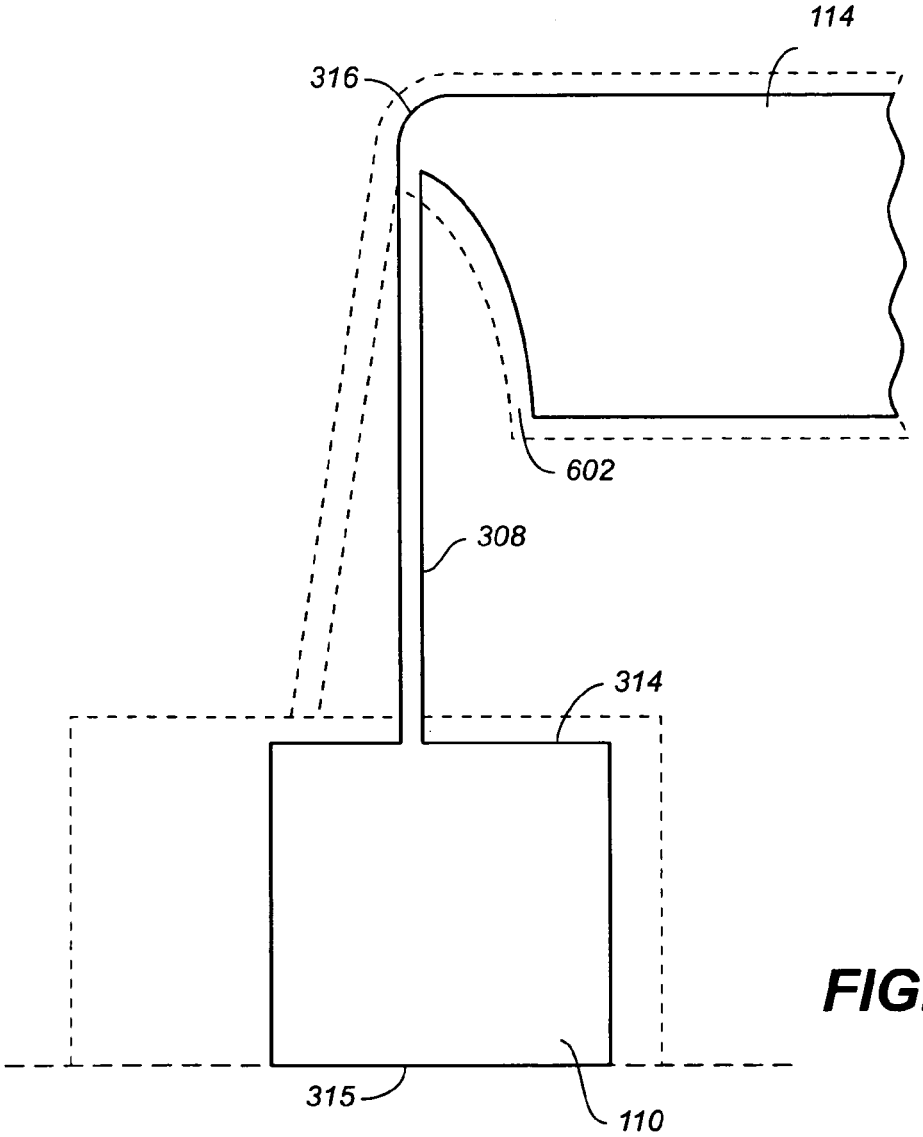
FIG. 6 is a view of a portion of the carrier head according to another implementation.

The effect of thermal expansion on a retaining ring 110 connected to a base 104 by a junction 132 of a type previously described in reference to FIGS. 3–5 is shown in FIG. 6. As noted above, a carrier head 100 can expand during polishing as a result of an increase in temperature. Since the material of the base 104 may be different from that of the retaining ring 110, an amount of base thermal expansion 602 may be different from an amount of retaining ring thermal expansion 604.

FIG. 6 shows a base 104 connected to a retaining ring 110 by a substantially narrow and substantially long support arm 308 extending from an upper outer surface 316 of a base 104 to a top surface 314 of a retaining ring 110. Each support arm 308 is formed of a singled unitary flexible portion. In this example, an amount of retaining ring expansion 604 exceeds and amount of base expansion 602, although the reverse could occur. During the expansion the support arm 308 flexes to accommodate for different rates of thermal expansion between the base 104 and the retaining ring. As a result, a bottom surface 315 of the retaining ring 110 remains flat in presence of thermal expansion.

As already mentioned, flatness of a bottom surface 315 of a retaining ring 110 is critical to ensure uniform wafer polishing. However, it may be desirable to be able to control the degree of uniformity. That is, it may be advantageous at some point during polishing, to increase the polishing rate at the perimeter of a substrate 10 relative to the polishing rate at the center of the substrate 10 for a brief time. Since the degree of uniformity of polishing depends in part on the shape of the bottom surface 315 of the retaining 10, it is desirable for the bottom surface 315 of the retaining ring 110 to be controllably deformable.

Figure 7A:
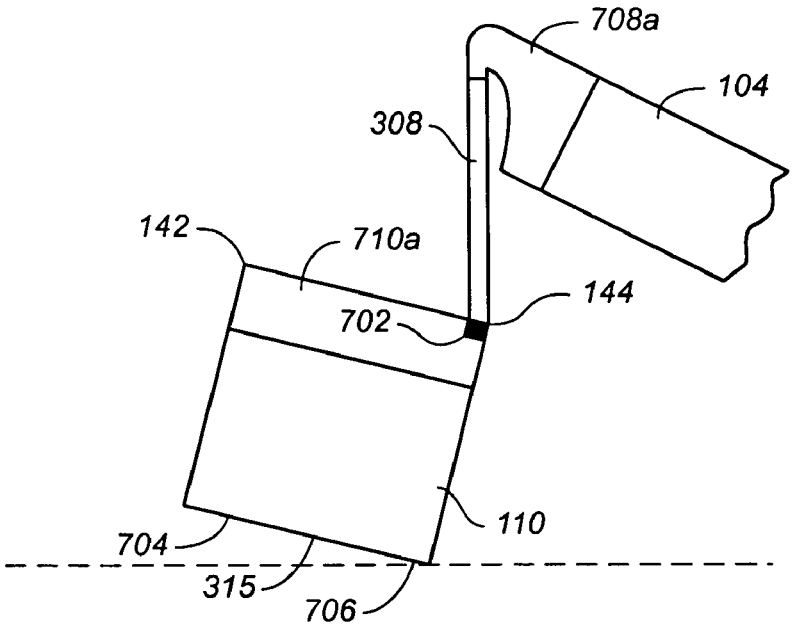
FIGS. 7A–7B are views of the portion of the carrier head according to another implementation in which a bottom surface of a retaining ring is controllably deformed.
Figure 7B:
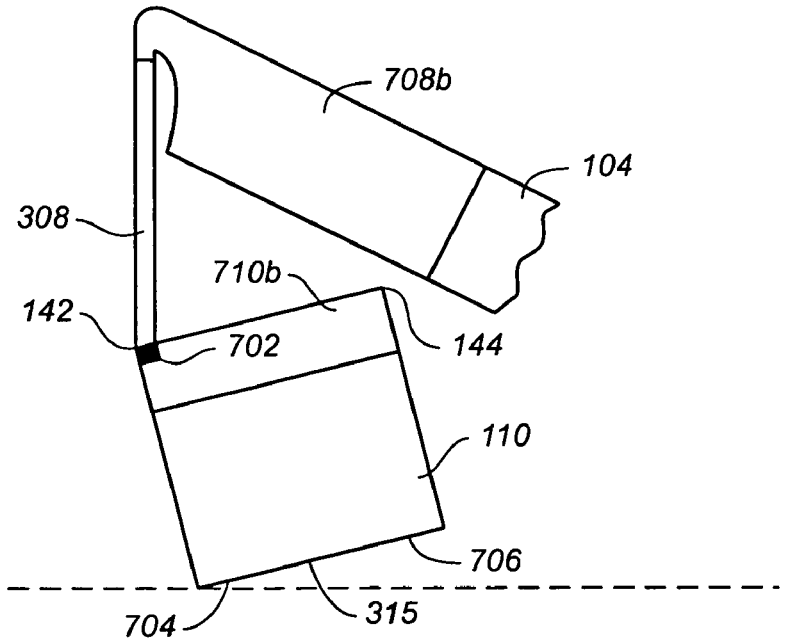

FIGS. 7A–7B show a retaining 110 with a controllably deformable bottom surface 315. The deformation of the bottom surface 315 of the retaining ring 110 can be controlled a lateral distribution of a downward pressure applied to a top surface 314 of the retaining ring 110 during polishing. In the particular implementation shown in FIGS. 7A–7B, the lateral distribution of a downward pressure applied to the top 314 surface of the retaining ring 110 is affected the lateral position of a point of attachment 702 between a support arm 308 (that extends from an upper outer surface 316 of the base 104 to a top surface 314 of a retaining ring 110) and the top surface 314 of the retaining ring 110.

As a point of attachment 702 between a support arm 308 and a top surface 314 of a retaining ring 110 moves inward (FIG. 7A), more downward pressure is applied to an inner diameter 312 of the retaining ring 110 and an outer diameter 310 of the retaining ring 110 is unloaded. Consequently, the retaining ring 110 flexes such that an outer edge 142 of the retaining ring 110 is raised relative to an inner edge 144 of the retaining ring 110. Consequently, a bottom surface 315 of the retaining ring 110 is deformed such that an outer portion 704 of the bottom surface 315 of the retaining ring 110 is raised relative to an inner portion 706 of the bottom surface 315 of the retaining ring 110. Although the exact result can depend on other polishing parameters, such as slurry composition, pressure, and pad stiffness, in general this results in a higher removal rate at the perimeter of a substrate 10 relative the removal rate a the center of the substrate 10. The amount of difference in the polishing rate between the perimeter of the substrate 10 and the center of the substrate 10 can be proportional to how far the support arm 308 moves in.

Likewise, as a point of attachment 702 between a support arm 308 and a top surface 314 of a retaining ring 110 moves outward (FIG. 7B), more downward pressure is applied to an outer diameter 310 of the retaining ring 110 and an inner diameter 312 of the retaining ring 110 is unloaded. Consequently, the retaining 110 flexes such that an inner edge 144 of the retaining ring 110 is raised relative to an outer edge 142 of the retaining ring 110. Consequently, a bottom surface 315 of the retaining ring 110 is deformed such that an inner portion 706 of the bottom surface 315 of the retaining ring 110 is raised relative to an outer portion 704 of the bottom surface 315 of the retaining ring 110. Although the exact result can depend on other polishing parameters, such as slurry composition, pressure, and pad stiffness, in general this results in a lower removal rate at the perimeter of a substrate 10 relative the removal rate a the center of the substrate 10. The amount difference in the polishing rate between the perimeter of the substrate 10 and the center of the substrate 10 can be proportional to how far the support arm 308 moves out.

The lateral position of a point of attachment 702 between a support arm 308 (that extends from an upper outer surface 316 of a base 104 to a top surface 314 of a retaining ring 110) and the top surface 314 of the retaining ring 110 can be selected in a number of ways. In one implementation, as shown in FIGS. 7A–7B, the lateral position of a point of attachment 702 between the support arm 308 and the top surface 314 of the retaining ring 110 can be selected by installing appropriate hardware 708*a*, 708*b*, 710*a*, 710*b*. For instance, the retaining ring can have a variety of detachable top portions 710*a*, 710*b* be secured to or released from the retaining ring 110. Different detachable top portions 710*a*, 710*b* can have the point of attachment 702 for the support arm 308 in different locations (e.g., a detachable top portion 710*a* with a point of attachment 702 for a support arm 308 near an inner diameter 312 of the retaining ring 110, or a detachable top portion 710*a* with an attachment point 702 for a support arm 308 near an outer diameter 310 the retaining ring 110). Likewise, a variety of detachable outer portions 708*a*, 708*b* that vary in their lateral extensions (e.g., an outer portion 708*a* that extends laterally to the inner diameter 312 of the retaining ring 110, or an outer portion 708*b* that extends laterally to the outer diameter 310 of the retaining ring 110) can be secured to and released from the base 104. To modify the lateral position of a point of attachment, the user can secure an appropriate detachable top potion of the retaining ring 110 and an appropriate detachable outer portion of the base 104 to the retaining ring 110 and to the base 104 respectively.

Figure 8A:
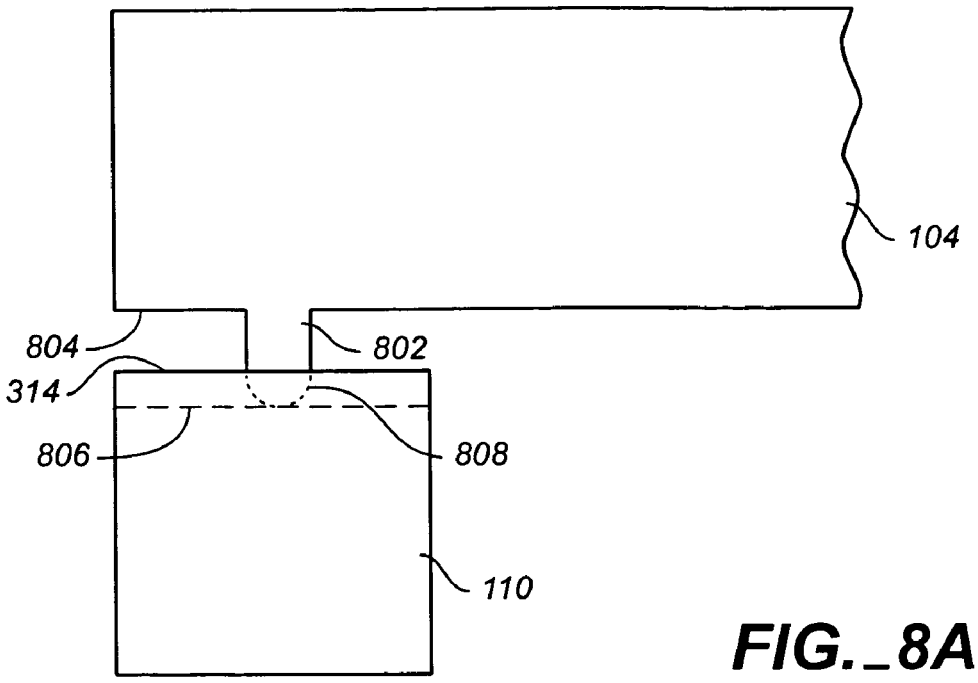
FIG. 8A is an expanded view of a portion of a carrier head according to another implementation.
Figure 8B:
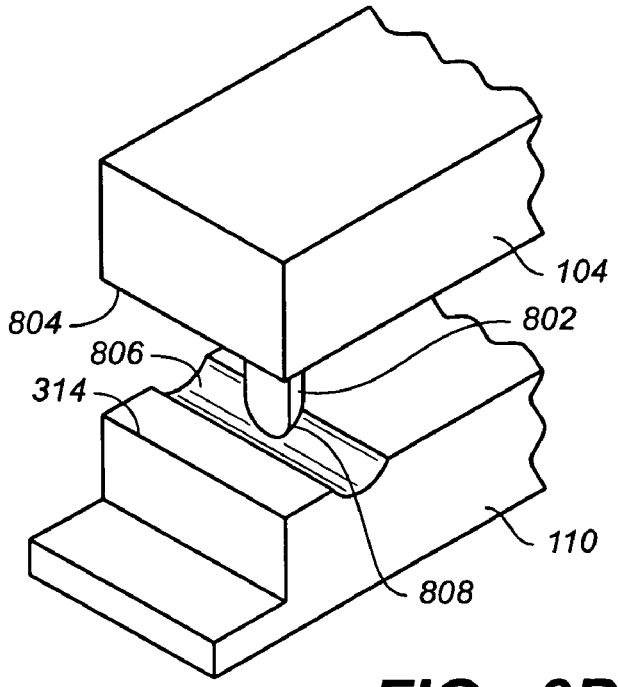
FIG. 8B is a perspective view of the portion of the carrier head of FIG. 8A.

FIGS. 8A–8B show another implementation of a junction 132 connecting a base 104 to a retaining ring 110. In one implementation, at least one support foot 802 (e.g., three) is attached to a bottom surface 804 of the base 104 and the support foot 802 rests on a recess 806 within a top surface 314 of the retaining ring 110. A bottom surface 808 of the support foot 802 is sufficiently rounded so that the base 104 can move angularly with respect to the top surface 314 of the retaining ring 110 when a download pressure is applied to the base 104 during polishing.

Figure 9:
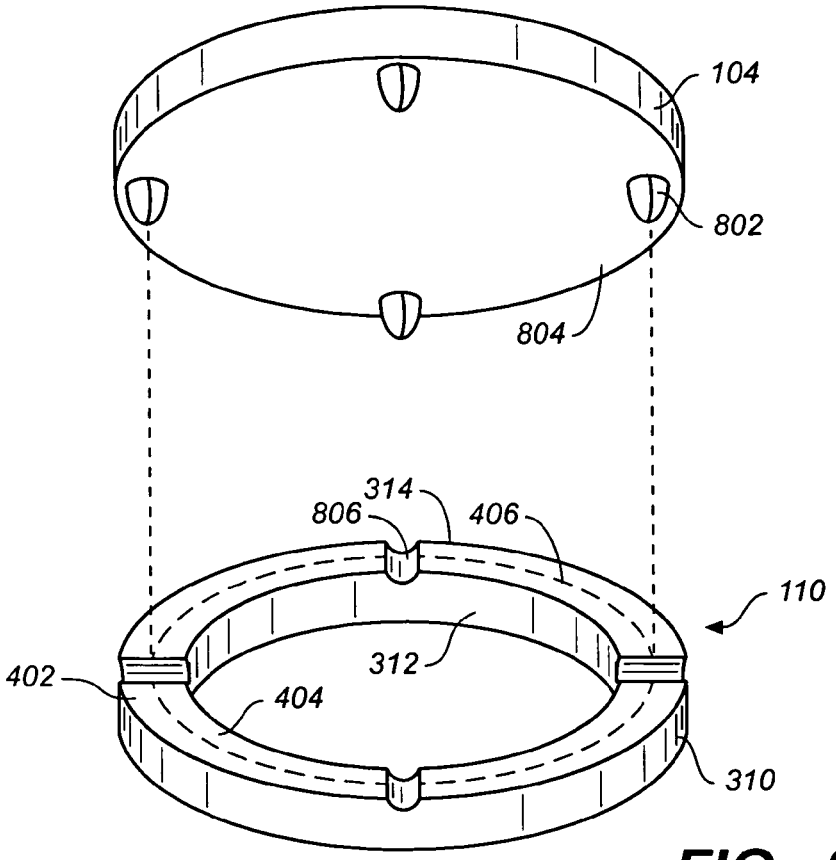
FIG. 9 is a perspective view of the retaining ring of FIG. 8A.

In one implementation, as shown in FIG. 9, support feet 802 are attached to a bottom surface 804 of the base 104 at substantially equal angular intervals. Recesses 806 within a top surface 314 of the retaining ring 110 are placed at the same angular intervals that separate consecutive support feet 802 on the bottom surface 804 of the base 104 so that the support feet 802 can rest on the recesses 806. Support feet 802 can rest on the recesses 806 along a substantially circular path 406. An area 402 of the top surface 314 of the retaining ring 110 between the substantially circular path 406 and the outer diameter 310 of the retaining ring 110 can be equal to an area 404 of the top surface 314 of the retaining ring 110 between the substantially circular path 406 and an inner diameter 312 of the retaining ring 110.

The lateral movement of a support foot 802 within a recess 806 on a top surface 314 of a retaining ring 110 is semi-restrained. A support foot 802 within a recess 806 can move radially inward or outward. As a result, if there are more than two support feet 802, there does not exist a lateral direction in which all support feet 802 can move. Consequently, the lateral movement of a support foot 802 is sufficiently restrained such that the support foot 802 remains on the top surface 314 of the retaining ring 110. At the same time, the lateral movement of a support foot 802 is sufficiently unrestrained such that the support foot 802 can move laterally along the top surface 314 of the retaining ring during thermal expansion.

Figure 10:
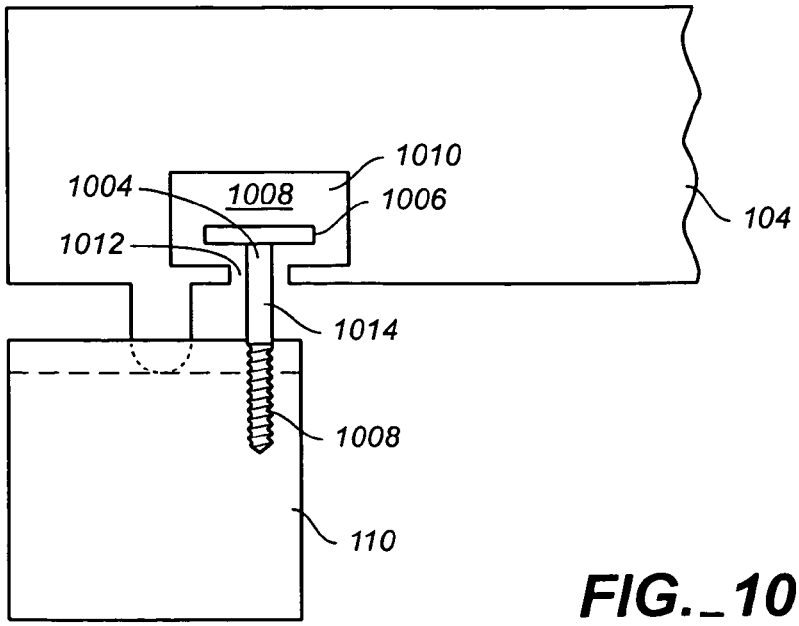
FIG. 10 is the expanded view of the portion of the carrier head according to an implementation that includes a mechanism for restraining the vertical movement of a retaining ring with respect to a base.

The vertical position of the base 104 with respect to the retaining ring 110 is substantially restrained. In one implementation, as shown in FIG. 10, the vertical position of the base 104 can be substantially restrained by a substantially rigid and vertical fastener. For instance, the base 104 can be attached to the retaining ring 110 by a screw 1004, or a bolt, placed substantially vertically, such that a head 1006 of the screw 1004 is housed within the base 104 and an outer part 1008 of a thread 1014 of the screw 1004 is housed within the retaining ring 110. The cavity 1008 within the base 104 that houses a part of the screw 1004 is filled with dampening material and consists of two substantially cylindrical sub-cavities—a lower sub-cavity 1010 and an upper sub-cavity 1012. The diameter of the lower sub-cavity 1010 is grater than the diameter of the thread 1014 of the screw 1004, and the diameter of the lower sub-cavity 1010 is smaller than the diameter of the head 106 of the screw 1004. The diameter of the upper sub-cavity 1008 is grater than the diameter of the head 1006 of the screw 1004.

Figure 11:
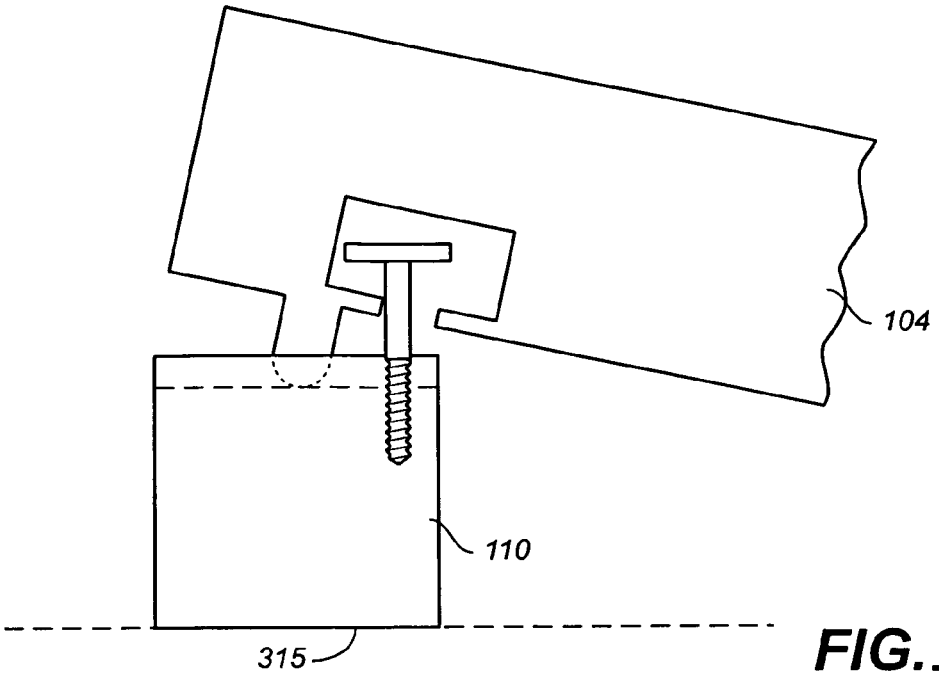
FIG. 11 is a cross-sectional view of the portion of the carrier head of FIG. 10 undergoing flexing during polishing.

As shown in FIG. 11, when a base 104 flexes as a result of a downward pressure applied to it during polishing, a flex movement of the base 104 does not result in an flex movement of the retaining ring 110, and a bottom surface 315 of the retaining ring 110 remains flat during polishing.

Figure 12:
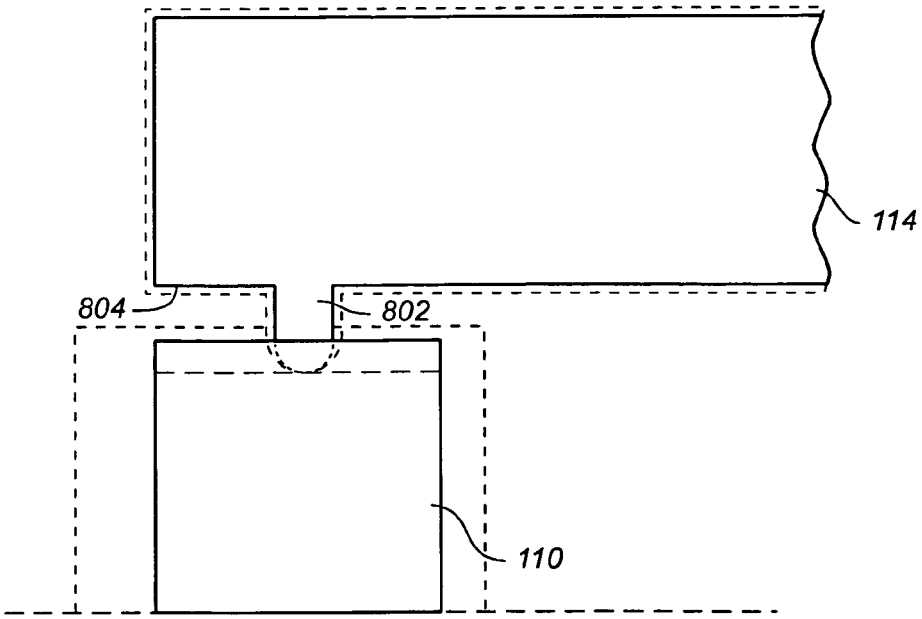
FIG. 12 is a cross-sectional view of the portion of the carrier head of FIG. 8A undergoing thermal expansion during polishing.

The effect of thermal expansion on retaining ring 110 connected to a base 104 by a junction 132 of a type previously described in reference to FIGS. 8–11 is shown in FIG. 12. During thermal expansion a support foot 802 that is attached a bottom surface 804 of the base 104 can move laterally along a recess 806 on a top surface 314 of the retaining ring 110 to accommodate for different rates of thermal expansion between the base 104 and the retaining ring 110. As a result, a bottom surface 315 of the retaining ring 110 can remain flat in presence of expansion or contraction (e.g., thermal expansion or thermal contraction).

Figure 13:
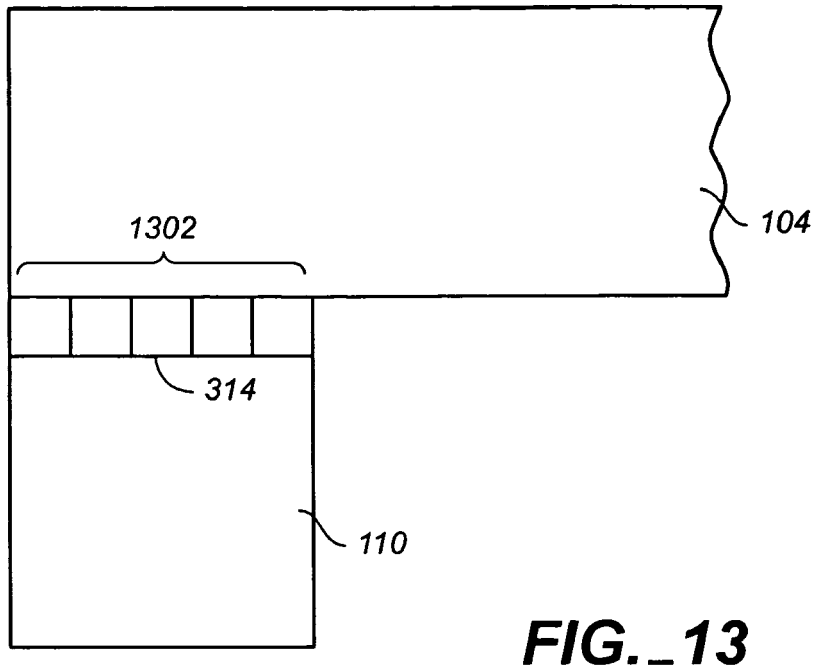
FIG. 13 is a cross-sectional view of a portion of a carrier head according to an implementation that includes actuators to controllably deform the bottom surface of the retaining ring.

FIG. 13 shows another implementation of a junction 132 connecting a base 104 to a retaining ring 110. The base 104 is connected to the retaining ring 110 by at least one array of actuators 1302. Each array of actuators 1302 is placed radially along a top surface 314 of the retaining ring 110. Various types of actuators 1302 can be used (e.g., mechanical actuators, piezo-electric actuators, and so forth) such that the extension of an actuator and the resulting downward pressure that the actuator 1302 applies to a portion of the top surface 314 of the retaining ring 110 is controllable. Consequently, the flex movement of the retaining ring 110 can be controlled by controlling the extension of the individual actuators 1302. In one implementation, arrays of actuators 1302 can be positioned at substantially equal angular intervals along the retaining ring 110.

Figure 14:
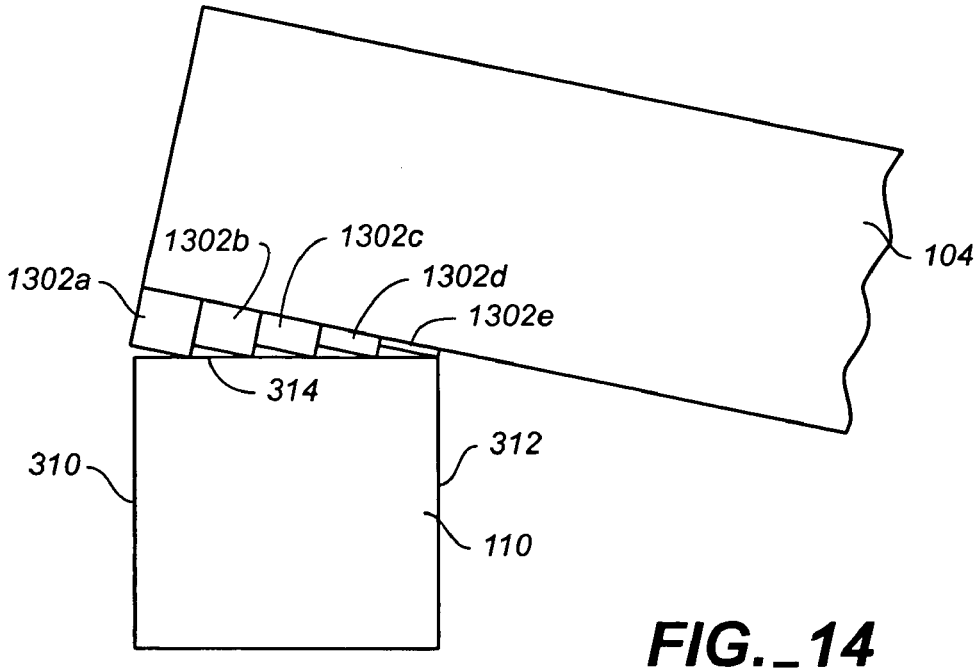
FIG. 14 is a view of the portion of the carrier head of FIG. 13 undergoing flexing during polishing.

As shown in FIG. 14, and as described earlier, when a base 104 flexes as a result of a downward pressure applied to it during polishing, a top surface 314 of a retaining ring 110 can experience more downward pressure near an inner diameter 312 of the retaining ring 110 than near an outer diameter 310 of the retaining ring 110. The downward extension of individual actuators 1302*a*–*e* can be controlled to compensate for the flexing of the base, such that the top surface 314 of the retaining ring 110 is maintained substantially planar. As a result, the bottom surface of the retaining ring remains flat.

In addition to maintaining the uniformity of the downward pressure on a retaining ring 110 (i.e., compensating for non-uniform downward pressure applied by a base 104 on the retaining ring 110), actuators can be controlled to compensate for the different rates of thermal expansion between the base 104 and the retaining ring 110. For instance, thermal actuators can be used to control the temperature of the retaining ring 110 and thus control the thermal expansion that the retaining ring 110 experiences.

A number of implementations of the invention have been described. Nevertheless, it will be understood that various modifications may be made without departing from the spirit and scope of the invention. For example, a support foot 802 in FIGS. 8–12 is attached to a bottom surface 804 of the base and rests on a top surface 314 of the retaining ring 110. Alternatively, the support foot 802 can be attached to the top surface 314 of the retaining ring, and the base 104 can rest on the support foot 802. The foot 802 can extend into a recess 806 that is closed at one or both ends. Also, the base 104 can be connected directly or indirectly to the drive shaft 74. Furthermore, the base 104 can be connected to the drive shaft 74 by vertical actuators that can affect the movement of the base 104. Accordingly, other embodiments are within the scope of the following claims.

What is claimed is:

1. A carrier head for chemical mechanical polishing of a substrate, comprising:

a carrier base;

a retaining ring with a top surface and a bottom surface; and a junction connecting the carrier base to the retaining ring, wherein the junction is configured such that vertical movement of the retaining ring is substantially restrained relative to the carrier base, and the junction is configured such that the profile of the bottom surface of the retaining ring is substantially decoupled from flexing of the carrier base.

2. The carrier head of claim 1, wherein the junction is configured such that a radial segment extending along the bottom surface of the retaining ring remains substantially flat during polishing.

3. The carrier head of claim 1, wherein the junction comprises one or more substantially long and narrow support arms that extend from an upper outer surface of the base to the top surface of the retaining ring, wherein each of the one or more substantially long and narrow arms has one or more flexible portions.

4. The carrier head of claim 3, wherein the one or more substantially long and narrow support arms comprise one continuous support arm.

5. The carrier head of claim 3, wherein the one or more substantially long and narrow support are connected to the top surface of the retaining ring along a substantially circular path.

6. The carrier head of claim 5, wherein the substantially circular path divides the upper surface of the retaining ring into two regions of equal area.

7. The carrier head of claim 1, wherein the junction comprises one or more support feet, wherein:

the one or more support feet are attached to the bottom surface of the carrier base;

the one or more support feet rest on the top surface of the retaining ring; and the one or more support feet are laterally movable relative to the retaining ring.

8. The carrier head of claim 7, wherein lateral movement of the one or more support feet on the top surface of the retaining ring is sufficiently restrained such that the one or more support feet remain on the top surface of the retaining ring.

9. The carrier head of clam 7, wherein vertical movement of the retaining ring is substantially restrained relative to the carrier base by one or more substantially rigid and vertical fasteners that connect the carrier base to the retaining ring.

10. A carrier head for chemical mechanical polishing of a substrate, comprising:

a carrier base;

a retaining ring with a top surface and a bottom surface; and a junction connecting the carrier base to the retaining ring, wherein the junction is configured such that the vertical movement of the retaining ring is substantially restrained relative to the carrier base, and the junction is configured such that the profile of a bottom surface of the retaining ring is substantially decoupled from expansion of the base.

11. The carrier head of claim 10, wherein a radial segment extending along the bottom surface of the retaining ring remains flat during polishing.

12. The carrier head of claim 10, wherein the junction comprise one or more substantially long and narrow support arms that extend from a upper outer surface of the base to the top surface of the retaining ring, wherein each of the one or more substantially long and narrow arms has one or more flexible portions.

13. The carrier head of claim 12, wherein the one or more substantially long and narrow support arms comprise one continuous support arm.

14. The carrier head of claim 12, wherein the one or more substantially long and narrow support arms are connected to the top surface of retaining ring along a substantially circular path.

15. The carrier bead of claim 14, wherein the substantially circular path divides the upper surface of the retaining ring into two regions of equal area.

16. The carrier head of claim 10, wherein the junction comprises one or more support feet, wherein:

the one or more support feet are attached to the bottom surface of the carrier base;

the one or more support feet rest on the top surface of the retaining ring; and the one or more support feet are laterally movable relative to the retaining ring.

17. The carrier head of claim 16, wherein lateral movement of the one or more support feet on the top surface of the retaining ring is sufficiently restrained such that the one or more support feet remain on the top surface of the retaining ring.

18. The carrier head of claim 16 wherein vertical movement of the retaining is substantially restrained relative to the base by one or more substantially rigid and vertical fasteners that connect the carrier base to the retaining ring.

19. A carrier head for chemical mechanical polishing of a substrate, comprising:

a carrier base;

a retaining ring with a top surface and a bottom surface; and a junction connecting the carrier base to the retaining ring, wherein the junction is configured such that the carrier base controls the deformation of the bottom surface of the retaining ring.

20. The carrier head of claim 19, where the junction is configured such that an inner portion of the bottom surface of the retaining ring is raised relative to an outer portion of the bottom surface of the retaining ring.

21. The carrier head of claim 19, wherein the junction is configured such that an outer portion of the bottom surface of the retaining ring is raised relative to an inner portion of the bottom surface of the retaining ring.

22. The carrier head of claim 19, wherein the carrier base controls the deformation of the bottom surface of the retaining ring by controlling a lateral distribution of a pressure applied to the top surface of the retaining ring.

23. The carrier head of claim 22, wherein the junction comprises one or more substantially long and narrow support arms that extend from an upper outer surface of the base to the top surface of the retaining ring.

24. The crier head of claim 23, wherein the carrier base controls the lateral distribution of the pressure applied to the top surface of the retaining ring by controlling the lateral position of the point of attachment between the one or more support arms and the top surface of the retaining ring.

25. The carrier head of claim 22, wherein the junction comprises one or more support feet, wherein:

the one or more support feet are attached to the bottom surface of the carrier base;

the one or more support feet rest on the top surface of the retaining ring; and the one or more support feet are laterally movable relative to the retaining ring.

26. The carrier head of claim 25, wherein the carrier base controls the lateral distribution of the pressure applied to the top surface of the retaining ring by controlling the lateral position of a contact location between the one or more support feet and the top surface of the retaining ring.

27. The carrier bead of claim 22, wherein the junction comprises one or morn arrays of one or more actuators.

28. The carrier head of claim 27, wherein at least one of the one or more actuators in the one or more arrays of the one or more actuators is a mechanical actuator.

29. The carrier head of claim 27, wherein at least one of the one or more actuators in the one or more arrays of the one or more actuators is a piezoelectric actuator.

* * * * *